US006059536A

United States Patent [19]

Stingl

[11] Patent Number: 6,059,536

[45] Date of Patent: May 9, 2000

[54] EMERGENCY SHUTDOWN SYSTEM FOR A WATER-CIRCULATING PUMP

[75] Inventor: David A. Stingl, Great Falls, Va.

[73] Assignee: O.I.A. LLC, McLean, Va.

[21] Appl. No.: 08/786,656

[22] Filed: Jan. 21, 1997

Related U.S. Application Data

[60] Provisional application No. 60/010,416, Jan. 22, 1996.

[51] Int. Cl.[7] ..... F04B 49/06

[52] U.S. Cl. ..... 417/44.2; 417/44.1; 4/541.2

[58] Field of Search ..... 417/44.2, 44.3; 4/541.2

[56] References Cited

U.S. PATENT DOCUMENTS

| | | |
|---|---|---|
| 2,680,168 | 6/1954 | Murphy . |
| 2,767,277 | 10/1956 | Wirth . |
| 4,107,492 | 8/1978 | Moon, Jr. et al. . |
| 4,460,812 | 7/1984 | Asahi . |
| 4,505,643 | 3/1985 | Millis et al. . |
| 4,620,835 | 11/1986 | Bell . |
| 4,762,969 | 8/1988 | Tracey . |
| 4,783,580 | 11/1988 | Bassin . |
| 4,867,645 | 9/1989 | Foster . |
| 5,120,198 | 6/1992 | Clark . |
| 5,167,041 | 12/1992 | Burkitt, III . |
| 5,190,442 | 3/1993 | Jorritsma . |
| 5,259,733 | 11/1993 | Gigliotti et al. . |
| 5,347,664 | 9/1994 | Hamza et al. . |
| 5,499,406 | 3/1996 | Chalberg et al. . |
| 5,570,481 | 11/1996 | Mathis et al. . |

OTHER PUBLICATIONS

Elissa S. Pollack, "Unrecognized Peril? . . . ", AQUA, pp. 63–64 (Jul. 1996).

"Important Points to Know About CalSpas", 10 pp.

Operating Instructions and Parts Manual for the TEEL Vacuum Switch, 4 pp. (1995).

Product specification sheet for Teel Vacuum switch.

*Primary Examiner*—Timothy S. Thorpe
*Assistant Examiner*—Ehud Gartenberg
*Attorney, Agent, or Firm*—James Creighton Wray; Meera P. Narasimhan

[57] ABSTRACT

An emergency shutdown system for a water-circulating pump monitors the vacuum on the influent side of a pump. The system includes a vacuum switch connected to the influent side of the pump by a vacuum line. The vacuum switch is connected to a pump shut-off switch which is, in turn, connected to the motor of the pump. When one of the influent lines leading to the pump becomes clogged or blocked, the vacuum switch, through the vacuum line, senses the increased suction and delivers an electrical shut-off signal. The pump shut-off switch opens in response to the electrical signal, thereby interrupting line power to the pump. Audible and visual alarms are also electrically connected to the vacuum switch. A main switch, including on, off, start and vacuum bypass positions, is included for manually activating and deactivating the pump motor and for enabling the pump to operate under selected high vacuum situations without deactivating the alarms. A siren key switch is also provided for turning off the audible alarms during pool maintenance. The components of the system are housed in a corrosion-resistant box having a deep base and a cover hinged and locked to the base.

35 Claims, 4 Drawing Sheets

EMERGENCY SHUTDOWN SYSTEM FOR A WATER-CIRCULATING PUMP

This patent is based on Provisional Application 60/010,416 filed Jan. 22, 1996, which was based on Disclosure Document 385,002 filed on or about Dec. 2, 1995. It is requested that the disclosure document be retained in the Patent and Trademark Office files.

BACKGROUND OF THE INVENTION

This invention relates to apparatus and systems for regulating pumps that are responsive to flow conditions.

Swimming pools, wading pools, spas, hot tubs, whirlpool baths, water parks and fountains are equipped with pumps for water circulation. Water is drawn from the pool or tub through one or more main drains connected by a main influent line to the suction side of the pump. Additional skimmer and vacuum port lines may also join into the main influent line. When one of the drain lines or skimmer lines becomes blocked, suction increases in the other lines. That results in a strong pulling force which drags objects in the pool or tub toward the drains. Swimmers, especially small children, are at risk of having hair, digits or entire limbs sucked into the influent lines, resulting in serious injury and possibly death. Needs exist for pump regulators that sense blockages in the influent lines and immediately disable the pumps.

Many deaths and numerous injuries occur each year as a result of pump-related accidents in swimming pools and hot tubs. In existing pools and tubs, when influent lines become clogged, no one is immediately alerted. Many existing pools and tubs have pump protection systems that sense low levels of water flow in the return line and disable the pump in response to those low level signals. While those systems may protect the pump from breakdown, children drawn by the increased suction will have already suffered fatal injuries. Needs exist for pump disabling systems that have quick reaction times and that protect against personal injury as well as equipment damage.

In response to public outcry demanding increased pool and tub safety, additional safety measures have been mandated in many jurisdictions. Faced with increased liability and high insurance costs, hotel and resort owners and public and private swimming clubs are actively searching for pump regulating systems that are not only effective in preventing personal injury but that are also retrofittable with existing pools and tubs and are cost-effective. Needs exist for pump regulating systems that are reliable, inexpensive and easily incorporated into existing pools and tubs.

SUMMARY OF THE INVENTION

The present invention is an emergency shutdown system for regulating a water-circulating pump. The system works by monitoring the vacuum on the influent side of the water-circulating pump. Whenever a blockage occurs in a water drain or a skimmer, the sudden rise in vacuum causes the system to immediately activate the pump shut-off switch and turn off the pump. Audible and visual alarms are also activated. The pump remains off until the system is manually reset at the pump control box. The present system is easily and relatively inexpensively retrofitted with existing water-circulating systems, including, but not limited to, swimming pools, wading pools, spas, hot tubs, whirlpool baths, water parks and fountains.

The present system includes a vacuum switch connected to the influent side of the pump by a vacuum line. The vacuum line may be retrofitted into existing pipe, installed into a reducing tee or threaded into a drain plug of the pump trap. The vacuum switch is connected to a pump shut-off switch which is, in turn, connected to the motor of the pump. The pump shut-off switch is preferably a high-current, three-pole contactor. A water and chemical resistant housing encases the system's wires and electronics, including the switches. When one of the influent lines leading to the pump becomes clogged or blocked, the vacuum switch, through the vacuum line, senses the increased suction and delivers a shutoff signal. The pump shut-off switch opens in response to the signal, thereby stopping line power to the pump motor. The pump motor is immediately deactivated, and suction in the influent lines ceases. Preferably, alarms, both audible and visual, are connected to the vacuum switch. When undesirable vacuum conditions are sensed, the vacuum switch delivers signals to the alarms, thereby activating the alarms. Audible and visual alarms, such as loud buzzers, bells, gongs, sirens and strobe lights, are positioned at both proximate and remote locations. The system also includes a manual override means for use when vacuuming or cleaning the pool or tub. The override means is preferably included with the control switch and allows the pump to operate under high vacuum situations but does not deactivate the alarms. A key-operated silence alarm switch is included to allow the audible alarms to be interrupted while not disabling the visual alarms. The pump remains off and the alarms remain activated until the system is restarted. Preferably, restarting the system includes turning the control switch to a spring-loaded start position which allows the system to override the initial vacuum surge created upon start-up of the pump. Once start-up is complete, the control switch is returned to the on position and the alarms are deactivated.

The present system includes a control switch, a silence alarm switch, lights and electrical connectors. The control switch preferably has four positions: off, vacuum bypass, on and start. In the off position, the pump and alarms are off. In the vacuum bypass position, the pump is on for pool vacuuming and the alarms are activated. In the on position, the pump is on and the alarms are "armed", or ready for activation should high suction be sensed in the influent line. In the spring-loaded start position, the vacuum switch is overridden and the pump is allowed to start. Alarms continue to flash and sound while high vacuum is detected.

A silence alarm switch is provided for deactivating the audible alarms. The switch is activated by a key, which is preferably only available to licensed pool technicians. The switch has a normal position, which permits audible alarms to sound, and a silent position, which disables audible alarms but not visual alarms.

Indicator lights are provided on the pump control box. One light, which is preferably red, indicates that the alarms are activated. A second light, which is preferably green, is activated whenever the pump is on.

Connections, such as 12 volt powered external siren and light connections and dry contacts for external alarms, may also be provided.

The present system includes several unique features that maximize convenience without sacrificing safety. The control switch of the system has a vacuum bypass position that allows for pool vacuuming. Normally, the high vacuum caused by the pool vacuuming causes the present system to sense a blockage condition and shut off the pump. In the vacuum bypass position, the present system is deactivated and the pump is allowed to run under a high vacuum situation. To prevent the system from being accidentally left in the deactivated condition, the audible and visual alarms are activated whenever the switch is in the vacuum bypass position.

Because the constant sounding of the audible alarms may be objectionable in certain instances, such as during extended pool maintenance, a key-controlled silence switch is provided. The silence switch allows an authorized person to deactivate the audible alarms by orienting the switch to its silent position. For safety reasons, the visual alarms are never disabled.

During normal start-up of the pump, high vacuum is detected at the influent side of the pump for a short amount of time. For that reason, the control switch of the present system is equipped with a spring-loaded start position. In that start position, the control switch overrides the vacuum sensor switch and allows the pump to be started. When the vacuum drops to normal values, as indicated by the red alarm light extinguishing, the operator may safely return the control switch to the normal on position.

The present system may be equipped with an auto-start relay. That relay is desirable for applications where the pump must be started without human intervention, such as when the pump is controlled by an external time clock or when the system is installed in areas where power is frequently lost. The auto-start timed relay bypasses the vacuum sensor switch for a preset amount of time to start the pump, just as a human operator would. All other operations of the auto-start embodiments of the present system are the same as the non-auto-start embodiments. The timed starting relay starts automatically when power is turned on. When installed, the timed relay obviates the need for a spring-loaded bypass start position for the control switch.

The present system is equipped standard with visual and audible alarms mounted in the pump control box. Connections for external powered and non-powered visual and audible alarms are also provided.

The pump shut-off switch is preferably a high-current, three-pole contactor. That permits the present system to be used with all types of pumps: 110, 220 VAC single phase, double phase and triple phase.

These and further and other objects and features of the invention are apparent in the disclosure, which includes the above and ongoing written specification, with the claims and the drawings.

DETAILED DESCRIPTION OF THE PREFERRED EMBODIMENTS

Figure 1:
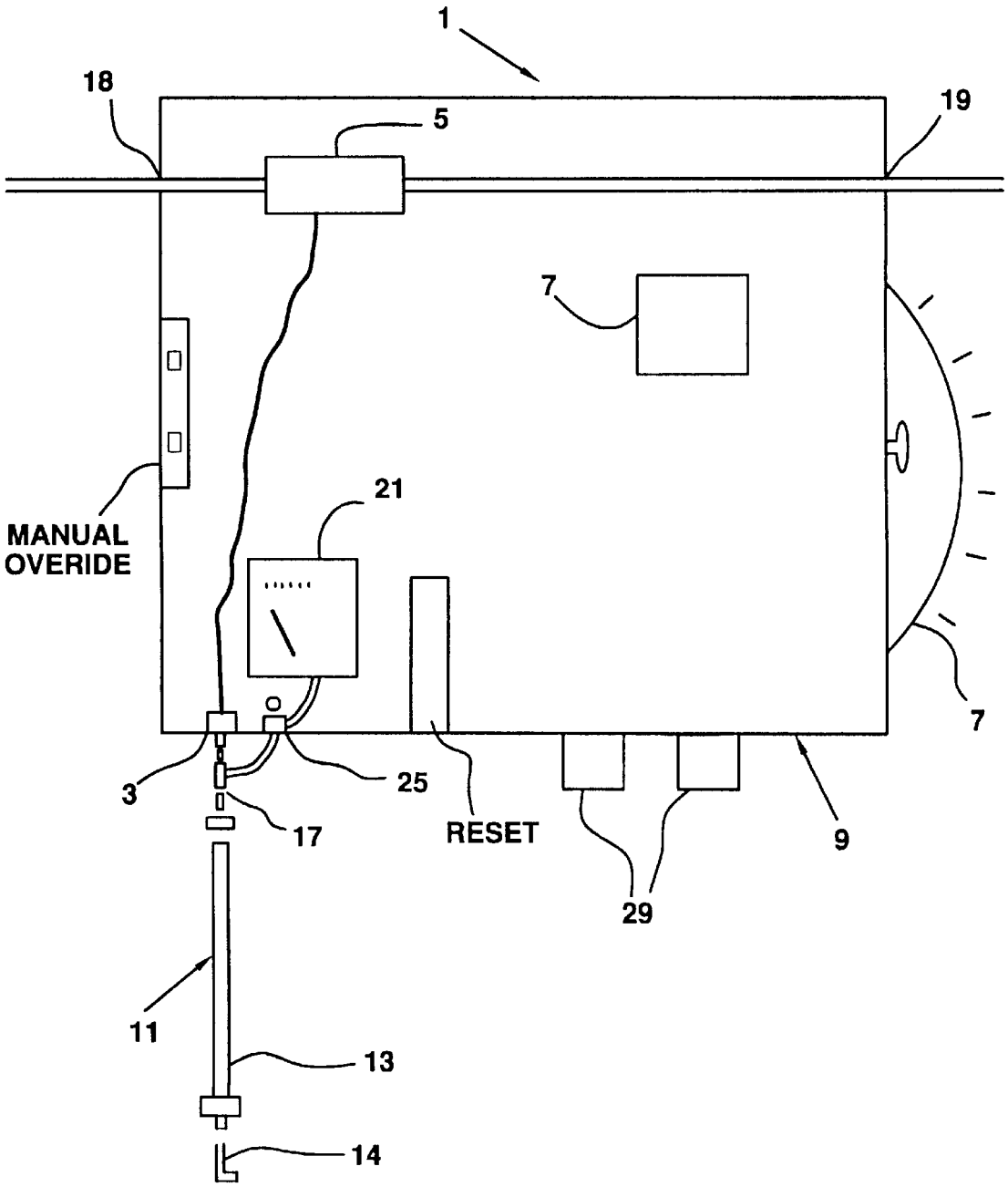
FIG. 1 is a schematic illustration of the present system.

As shown in FIGS. 1–4, the present invention 1 operates by monitoring the vacuum on the influent side of a water-circulating pump. Whenever a blockage occurs in the influent lines extending from the main drains, skimmers or vacuum ports, a sudden rise in vacuum is sensed. Upon sensing that vacuum change, the vacuum switch 3 of the present system 1 immediately sends a signal to the pump shut-off switch 5, which in turn deactivates the pump. Concurrently, visual and/or audible alarms 7 are activated. The pump remains off and the alarms 7 remain activated until the system 1 is manually reset.

The present system 1 preferably includes a pump control box 9, a vacuum line 11 for connecting the control box 9 to the influent side of the pump and proximate and remote alarms 7 connected to the control box 9. The vacuum line 11 has a first end 13 connected to the influent side of the pump. In preferred embodiments, the first end 13 is tapped into an existing influent line, installed into a reducing tee or threaded into the drain plug of the pump trap. In those embodiments wherein the influent side of the pump includes multiple branches extending to different drains, vacuum ports and skimmers, the first end 13 is preferably connected to a common artery leading directly to the pump. In one embodiment, the vacuum line 11 includes multiple ends 13, with each end 13 connected to a different branch in the influent lines.

Figure 2:
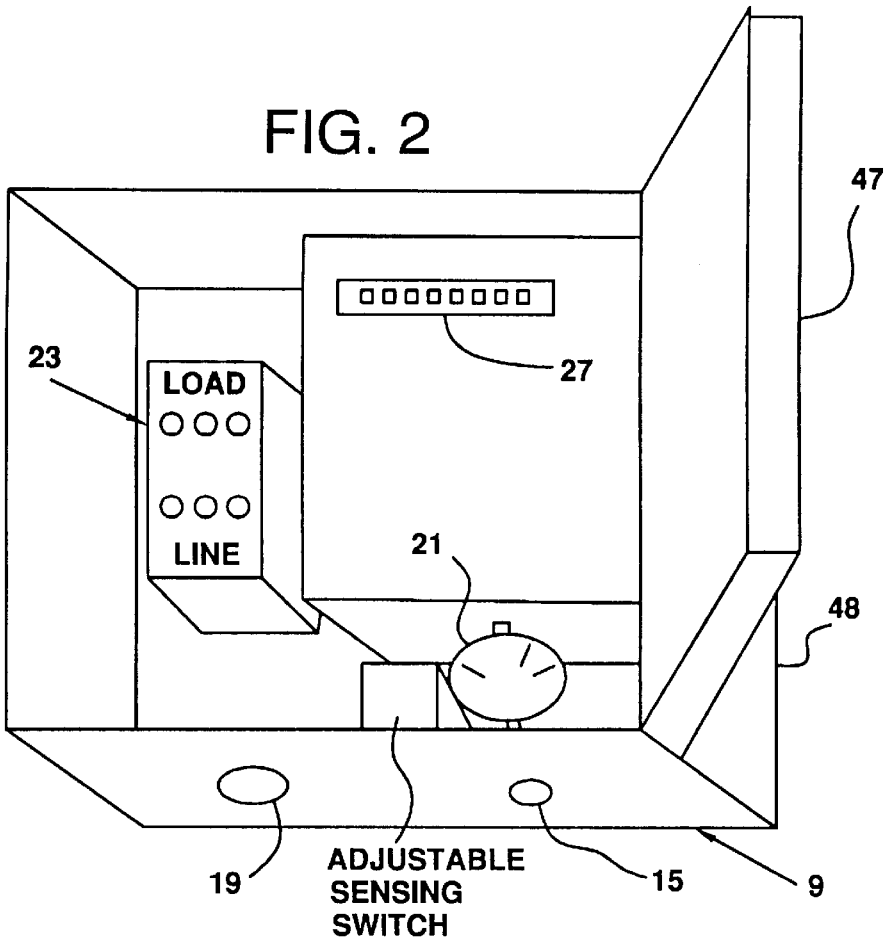
FIG. 2 schematically illustrates the internal components of the present system.
Figure 3:
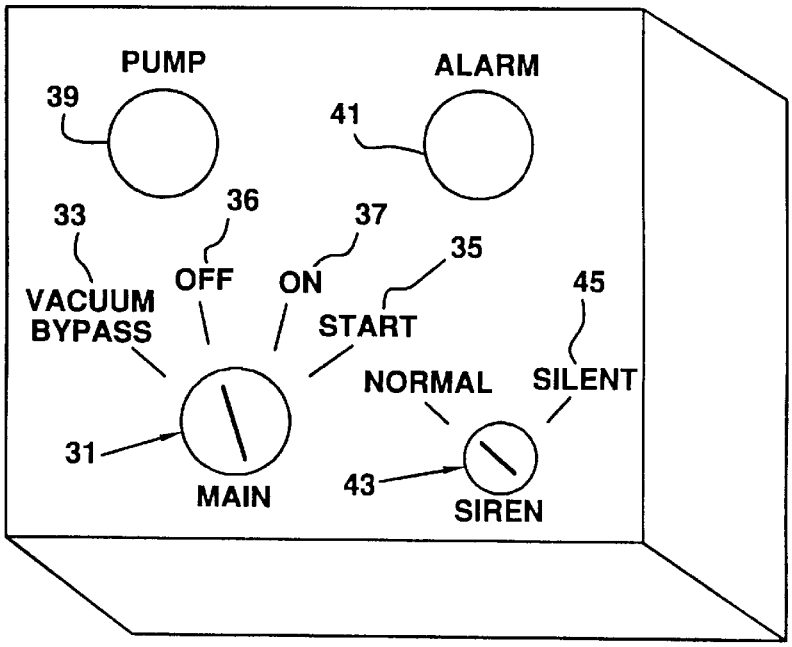
FIG. 3 is a schematic illustration of the external components of the present system.

FIGS. 1–3 generally show the pump control box 9. The box 9 has a first opening 15 for receiving a second end 17 of the vacuum line 11 and second and third openings 18, 19 for receiving lines extending from a power source and to the motor. Clamps and connectors may be used for securing the lines to the box 9. The box 9 houses a vacuum sensing switch 3, a vacuum gauge 21 and the pump shut-off assembly 23. The sensing switch 3, which is preferably an adjustable vacuum switch, is connected to the second end 17 of the vacuum line 11 and the pump shut-off assembly 23. The vacuum gauge 21 is also connected to the second end 17 of the vacuum line 11, through a manifold. As shown in FIG. 1, a vacuum reset bleeder 25 is preferably positioned in the connection between the vacuum gauge 21 and the vacuum line 11. The pump shut-off assembly 23 preferably includes a relay and a shut-off switch 5. The shut-off switch 5 is positioned in the lines extending from the power source to the motor. When high vacuum conditions are sensed by the vacuum switch 3, the shut-off switch 5 interrupts the flow of current from the power source to the motor, thereby immediately deactivating the pump. The pump shut-off switch 5 is preferably a high-current, three-pole contactor. Use of that contactor permits the present system to be compatible with all types of pumps, including single phase, double phase and triple phase pumps.

Figure 4:
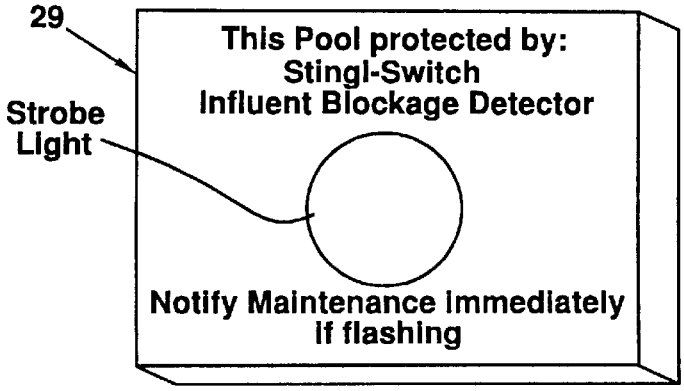
FIG. 4 is a schematic illustration of a remote alarm of the present system.

As shown in FIG. 1, the pump control box 9 is equipped with alarms 7. Both visual and audible alarms may be mounted in the box 9. The alarms 7 are connected to the vacuum switch 3. When high vacuum conditions are sensed, the vacuum switch 3 sends activating signals to the alarms 7. As shown in FIG. 2, the control box 9 has terminals 27 for external alarms 7. External-powered and non-powered visual and audible alarms 7 may be connected to the vacuum switch 3 through those connections. FIG. 4 is an example of an external alarm box 29. Optional connections include, but are not limited to, a 24 volt powered external siren connection, a 24 volt powered external light connection, dry contacts for external siren connection and dry contacts for external light connection.

FIG. 3 is a preferred embodiment of the external features of the pump control box 9. The box 9 includes a control switch 31 for turning the system 1 on or off. As shown in FIG. 3, the switch 31 preferably has a vacuum-bypass position 33. The switch 31 is rotated to that position 33 by a pool attendant during pool vacuuming. Normally, the high vacuum caused by the pool vacuuming would cause the present invention 1 to sense a blockage condition and, in response, to shut-off the pump. When the control switch 31 is placed in the vacuum-bypass position 33, the vacuum sensing switch 3 is deactivated or overridden, and the pump continues to run under high vacuum conditions. To prevent the system from being left in that position 33, the audible and visual alarms 7 remain activated when the control switch is in the vacuum-bypass condition.

As shown in FIG. 3, the control switch is left in off position 36. The control switch 31 also preferably has a start position 35. During normal start-up of pumps, very high vacuum is detected for a short period of time in the influent side of the pump. When the control switch 31 is positioned in a spring-loaded start position 35, shut-off signals from the vacuum switch 3 which control the shut-off switch 5 are overridden and the pump is allowed to be started. When the vacuum drops to normal values the switch 31 is safely returned to the on position 37. Preferably, the alarms 7 remain activated while high vacuum is detected.

As shown in FIG. 3, the pump control box 9 preferably includes a first lamp 39 indicating that the pump is on, and a second lamp 41 indicating high vacuum is being sensed. Lamps 39, 41 are preferably different colors.

FIG. 3 further shows a preferred pump control box 9 having a key-operated switch 43 for bypassing the audible alarm. Because the constant sounding of the audible alarm may be objectionable in certain situations (i.e., during extended pool maintenance), the key-controlled switch 43 allows an authorized person to deactivate the audible alarm by moving the switch 43 to the silent position 45. That interrupts the control from the vacuum switch 3 to the audible alarms. For safety reasons, however, the visual alarms remain activated. The key for operating the switch 43 is preferably available only to certified pool technicians and is stored in a safe location.

The pump control box 9 is preferably a water and chemical resistant housing. The box 9 preferably has a cover 47 and a deep body 48, as shown in FIG. 2. Hinges at one side allow opening of the box 9. A seal and locking hasp clamps keep the box 9 closed and watertight.

To operate the present system, the control switch 31 is turned from the off position 36 past the on position 37 to the spring-loaded start position 35. Nothing occurs when the switch 31 is turned to the on position 37 until the start sequence is completed. The switch 31 is held in the start position 35, the pump is started and the alarms 7 are activated. When the alarm indicator 41 extinguishes, indicating that vacuum in the influent lines has returned to a safe value and the alarms 7 are deactivated, the switch 31 is released to the on position 37. The pump indicator 39 indicates that the pump is running. In the event of blockage, vacuum increases in the influent line and the vacuum switch 3 is activated. The vacuum switch 3 controls the pump shut-off assembly 23 and the alarms 7. The pump shut-off switch 5 is immediately activated, cutting off all current to the pump motor, thereby disabling the pump. The alarms 7 are activated, thereby alerting people in the immediate area and at remote locations that there is a blockage.

Once the blockage is removed, the system is restarted as described above.

For embodiments of the present system including the auto-start feature, the system is activated by turning the control switch 31 to the on position 37. The auto-start timed relay energizes, starting the pump just as if the human operator were holding the switch 31 in the start position 35 for a preset amount of time. During the auto-start sequence, lamps 39 and 41 are activated as the pump primes. After a preset amount of time, the auto-start relay releases, thereby arming the present system. If the pump does not prime before the preset time has elapsed, the system 1 safely turns off. In embodiments where the auto-start feature is installed, the pump can be started manually using the spring-loaded start switch, as described above.

The present invention 1 is easily incorporated into existing pools and spas. The pump control box 9 is mounted in a convenient location near the pump. One end 13 of the vacuum line 11 is connected to a port on the influent side of the pump. A T-fitting is used, if appropriate. The opposite end 17 of the vacuum line 11 is connected to the vacuum switch 3 through the vacuum connection 15 of the pump control box 9. Making sure all power lines are disconnected, the power lines are connected in series across the pump shut-off switch 5. The present system is preferably equipped with a three-pole contactor which allows easy connection to single phase 110V, two-phase 220V and three phase pumps. An AC power supply is connected to the circuit board. Jumpers are provided for 110V or 220V operations. Importantly, the present invention derives all necessary power from that connection. The line voltage is stepped down in a transformer and rectified to provide dc power to the controls. Next, external alarm boxes 29 are connected to the external siren and light terminals 27 of the pump control box 9. Dry contacts may be used as input to other security systems. Power is then restored to the system 1. Once power is restored, the control switch 31 is turned past the on position 37 to the spring-loaded start position 35. The pump starts, but the switch 31 is held in position 35 for a short time until vacuum stabilizes. Once vacuum stabilizes, the operator should note the reading and set the adjustable vacuum switch 3 to a value higher than that reading. Preferably the set value is approximately five inches of mercury higher than the stabilized vacuum reading. Lower values may cause excessive false alarms. Higher values, while reducing false alarms, decrease the safety factor of the system.

For auto-start embodiments of the present system, the time delay for the auto-start relay must be set. To set the relay, the pump is manually started as described above. The time elapsed from the first pressing of the start switch to the point where the pump primes is then calculated. Preferably, the auto-start relay dial is set at the calculated value plus five seconds.

Figure 5:
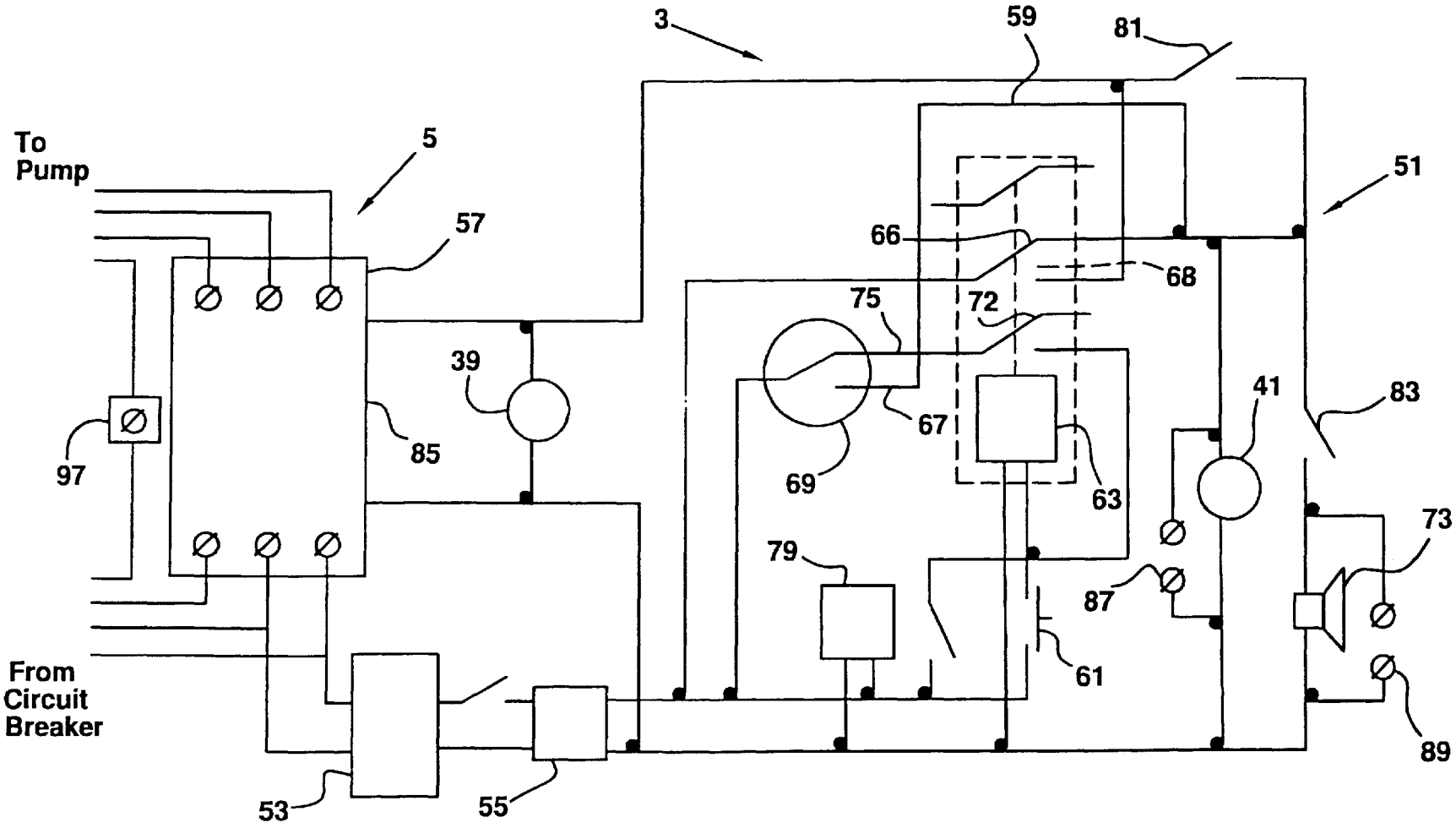
FIG. 5 is a schematic circuit of the present system.

FIG. 5 shows a preferred circuit 51 for use in the present system 1. The majority of mounting logic for the present system 1 is provided on a circuit board that is removable from the pump control box 9. A tap of 120VAC or 220VAC provides 12VDC power for the circuit 51 through a 12V transformer 53 and a bridge rectifier 55. Upon power up, the three-pole contactor 57 and relay 59 are in de-energized positions. Pressing the start switch 61 energizes the relay coil 63, causing one set of the relay contacts to energize the coil of the contactor 57 and start the pump. The starting of the pump is indicated by the lighting of the green lamp 59. High vacuum on the influent side of the pump is always associated with priming of the pump, thereby causing the circuit 51 to signal an alarm condition. In the present circuit 51, the alarm energization is provided through the normally closed contacts 66 of relay 59 and through the "HI" position 67 of the vacuum sensor 69. The operator holds the start switch 61 by passing the "LO" position 75 of the relay driver and opening the normally closed contacts. The alarms 41, 73 remain energized through the "HI" position 67 of sensor 69 until the vacuum sensor 69 falls below the set safety limit. The vacuum sensor 69 moves to the "LO" position 75. Lamp 41 and alarm 73 extinguish, and the operator is thus prompted to release the start switch 61 to its on position. In its on position the relay 59 is held energized by current flowing through the "LO" contact 75 on the vacuum sensor 69 and one of the normally open contacts 77 of the logic relay 59 to the coil 63. When the vacuum sensor 69 goes high, the relay coil 63 is de-energized, opening the normally open contacts and closing the normally closed alarm contact.

When the auto-start option of the present system is installed, the time-delay relay 79, upon power up, energizes for a preset amount of time, performing the same function as manually holding the start switch 61.

When an influent line is blocked, the vacuum at the influent side of the pump quickly exceeds the safe value set on the vacuum sensor 69. The vacuum sensor 69 switches to the "HI" position 67, breaking the holding circuit to the coil 63 and causing the relay 59 to release. Contacts 68 open, stopping the energizing of coil 85. The contactor 57 is immediately de-energized, thereby stopping the pump. Alarms 41 and 73 are also triggered by the losing of contact 66. Sensor 69 and relay 59 are part of the vacuum switch 3. Coil 85 and contactor 57 are analogous to the pump shut-off switch 5, shown in FIG. 1.

With the pump off, the vacuum sensor 69 immediately switches back to the "LO" position 75. The pump cannot restart, however, because the contacts 72 of relay 59 are open and cannot energize the relay driver coil 63, as the lower set of contacts is now open. The pump can only be restarted by initiating the start sequence as described above.

When the pool is cleaned or vacuumed, the vacuum on the influent side of the pump often exceeds the safety limit. Since that condition would cause the present system to shut off the pump, making vacuuming impossible, a vacuum bypass switch 81 is provided. Switch 81 bypasses the relay 59, forcing the contactor 57 to stay energized regardless of the influent vacuum level. That is a potentially dangerous situation, as the safety features of the present system 1 are bypassed. Alarms 41 and 73 are activated during the entire vacuuming process to remind the operator to return the system to its active, on position. That constant alarm function is provided by the normally closed contacts 66 at the top of the relay 59. Normally closed contacts 66 also provide power to the vacuum pool bypass switch. When relay 59 is energized no power may be provided through the vacuum bypass switch.

For maintenance purposes, sound alarms 73 are deactivated by authorized personnel by inserting a key in the silence alarm switch 83. The light alarms 41 are not deactivated, and the safety of the relay 59 is not affected by activation of the key switch 83.

The power supply provided by transformer 53 and rectifier 55 is capable of providing power for the relay 59, lamps 65 and 41 and contactor coil 85. In addition, external sound and light alarms are preferably provided for observation outside of the pump house. Connections for the external light alarms and sound alarms are provided in FIG. 5 as 87 and 89, respectively.

Figure 6:
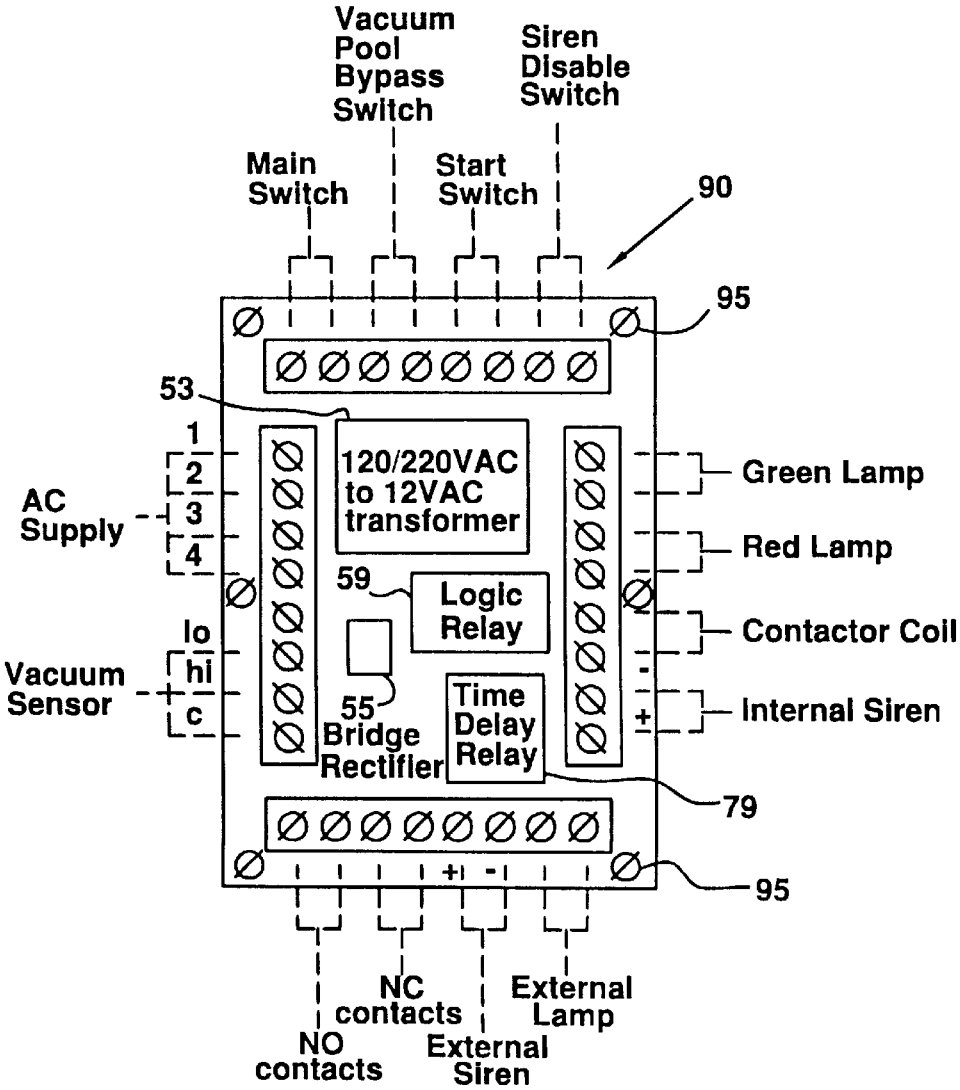
FIG. 6 is a schematic illustration of the circuit board parts arranged for use in the present system.

FIG. 6 shows a preferred circuit board 90 for use in the present system 1. The circuit board 90 provides a neat, simple and reliable location for the elements of the present system 1. To reduce manufacturing costs, the circuit board 90 is preferably produced using printed circuit board techniques. The circuit board is mounted in the deep body 48 of the control box 9 using screws 95. By including a modular circuit board 90, the system 1 is easier to repair and upgrade in the field, as only a screwdriver is needed to remove or replace the entire circuit board 90.

Four AC supply terminals 91, 92, 93, 94 provide for easy connection of the present system 1 to single-phase 110V and 220V, two-phase and three phase pumps. For 110VAC operation, the operator connects 110VAC across 91 and 92, jumpers 91 to 93 and jumpers 92 to 94. For 220VAC operations, the operator connects 220VAC across 91 and 94 and jumpers 92 to 93. For triple phase operation, the operator proceeds the same as for 110VAC operations. A separate ground lug is provided for safety. All high voltage is limited to a small section of the logic board 90. Only 12VDC is used in the panel switches for safety.

In preferred embodiments, as shown in FIGS. 2 and 3, the components of the present system are positioned in a pump control box 9 that is positioned in the pump house. The box 9 preferably has a deep body 48 and a cover 47 that overlies the body 48. Preferably, the cover 47 is connected to the body 48 along one side by hinges or other acceptable connectors. Latches or other connectors may be provided on sides of the body 48 and cover 47 for securing the cover 47 in a closed position overlying the body 48. In preferred embodiments, a mounting board is positioned in the body 48 of the box 9. The board preferably lies parallel to the bottom of the body 48 and is secured to the body 48. A circuit board, such as the one shown in FIG. 6, is connected to the mounting board by screws or other acceptable fasteners. The vacuum switch and vacuum gauge are mounted on a manifold that is connected to a side wall 97 of the body 48. Electrical connections extend between the vacuum sensor and appropriate terminals on the logic board. A three-pole contactor is positioned on the mounting board adjacent the logic board. Electrical connections extend between the contactor and appropriate terminals on the logic board. Preferably, an audible alarm is externally mounted and connected to the logic board by electrical connections.

In preferred embodiments, lamps 39 and 41, key switch 43 and control switch 31 are mounted in the cover 47. Electrical connections extend between the components mounted to the cover and the logic board.

While the invention has been described with reference to specific embodiments, modifications and variations of the invention may be constructed without departing from the scope of the invention, which is defined in the following claims.

I claim:

1. An emergency shutdown system for a pool or spa water-circulating pump comprising a pool or a spa, a power source, a pump motor connected to the power source, a water-circulating pump connected to the motor, the pump having an influent side and an intake and an exhaust, an effluent side, the influent side further comprising an influent line connected to the intake of the pump, the effluent side further comprising an effluent line connected to the exhaust of the pump, a vacuum switch connected to the influent side for providing an electrical shut-off in response to increased vacuum on the influent side, a pump switch electrically connected between the power source and the motor, the pump switch being connected to the vacuum switch for receiving the electrical shut-off from the vacuum switch, wherein the pump switch breaks electrical connection between the power source and the motor in response to the receiving of the electrical shut-off from the vacuum switch, an audible alarm and a visual alarm electrically connected to the vacuum switch for energizing the alarms upon increased vacuum on the influent side, the system further comprising an on-off switch, a start switch and a vacuum bypass switch, the start switch electrically overriding the electrical shut-off to the pump switch for electrically connecting the power source to the motor during high vacuum level pump start-up, the bypass switch electrically overriding the electrical shut-off to the pump switch for electrically connecting the power source to the motor during high vacuum use of the water-circulating pump for pool or spa vacuuming.

2. The emergency shutdown system of claim 1, further comprising a vacuum gauge, and wherein the vacuum switch is adjustable for selecting precise levels of sensed vacuum at which to provide the electrical shut-off.

3. The emergency shutdown system of claim 2, further comprising a box with a lockable cover, and wherein the adjustable vacuum switch and the vacuum gauge are mounted in the box with the cover.

4. The emergency shutdown system of claim 1, further comprising a key-operated audible alarm overriding switch and a pump control box, wherein the start switch, on-off switch and vacuum bypass switch are combined in one four-position main control switch, and wherein the main control switch and the audible alarm overriding switch are mounted on the pump control box.

5. The emergency shutdown system of claim 4, wherein the pump switch is a pump relay, and wherein the pump relay is mounted in the pump control box under the cover.

6. The emergency shutdown system of claim 1, further comprising alarm terminals for external alarms connected to the vacuum switch, and wherein the alarms are external audible and visual alarms connected to the alarm terminals.

7. The emergency shutdown system of claim 1, further comprising a check valve connected between the influent side and the vacuum switch.

8. The emergency shutdown system of claim 7, further comprising a vacuum reset bleeder connected between the vacuum switch and the check valve.

9. The emergency shutdown system of claim 1, wherein the start switch, on-off switch and vacuum bypass switch form a portion of main control switches, the main control switches having a vacuum bypass position, an off-position, an on position and a start position, and wherein the start position is spring-loaded to return the main control switches to the on position.

10. The emergency shutdown system of claim 1, further comprising a timed auto start relay electrically connected to the start switch for providing a timed start sequence for pump priming.

11. The emergency shutdown system of claim 10, wherein the timed auto start relay is adjustable and is electrically connected to the on-off switch for energizing the auto start relay and for bypassing the start switch when the water-circulating pump is operated with an automatic timer or automatically after power outages.

12. The emergency shutdown system of claim 1, further comprising an internal power supply connected to the power source and to the on-off switch, to the pump switch and through the on-off switch to the vacuum switch, and through the vacuum switch to the pump switch, for providing low voltage dc power to the system and for providing the electrical shut-off to the pump switch.

13. The emergency shutdown system of claim 12, wherein the internal power supply comprises a step-down transformer connected to the power source and a bridge rectifier connected to the step-down transformer and to the on-off switch.

14. The emergency shut-down system of claim 13, wherein the pump switch is a pump relay, and wherein the vacuum switch further comprises a logic relay having a coil, normally-open contacts and normally-closed contacts, wherein the start switch is connected to the coil for energizing the coil and thereby closing the normally-open contacts for supplying power from the rectifier through the closed normally-open contacts to the pump relay, and wherein the vacuum switch is connected to the rectifier and to the coil for energizing the coil when the vacuum switch is in a low vacuum condition and thereby closing the normally-open contacts for supplying power from the rectifier through the closed normally-open contacts to the pump relay, and a vacuum sensor connected to the rectifier and the coil for energizing the coil when the vacuum sensor is in a low vacuum condition and thereby closing the normally-open contacts for supplying power to the pump relay through the closed normally-open contacts while the coil is energized, and thereby allowing the normally-closed contacts to supply power to alarms when the coil is deenergized.

15. The emergency shutdown system of claim 1, wherein the alarms further comprise an audible alarm and an audible alarm overriding switch connected to the audible alarm for preventing operation of the audible alarm.

16. The emergency shutdown system of claim 1, further comprising a vacuum line connected to and extending between the influent side and the vacuum switch.

17. The emergency shutdown system for a pool or spa water-circulating pump, comprising a pool or a spa, a power source, a pump motor connected to the power source, a water-circulating pump connected to the motor, the pump having an influent side and an effluent side, an influent line connected to the influent side of the pump, an effluent line connected to the effluent side of the pump, a vacuum switch connected to the influent side for providing an electrical shut-off in response to increased vacuum on the influent side, a pump switch electrically connected between the power source and the motor, the pump switch being connected to the vacuum switch for receiving the electrical shut-off from the vacuum switch, wherein the pump switch breaks electrical connection between the power source and the motor in response to the receiving of the electrical shut-off from the vacuum switch, an audible alarm and a visual alarm electrically connected to the vacuum switch for energizing the alarms upon increased vacuum on the influent side, an off-on switch, a start switch and a vacuum by-pass switch, the start switch electrically overriding the electrical shut-off to the pump switch for electrically connecting the power source to the motor during high vacuum level pump start-up, the vacuum bypass switch electrically overriding the electrical shut-off to the pump switch for electrically connecting the power source to the motor during high vacuum use of the water-circulating pump for pool or spa vacuuming; and wherein the start switch, on-off switch and vacuum by-pass switch form a portion of a main control switch, the main control switch having a vacuum bypass position, an off position, an on position, and a start position, and wherein the start position is spring-loaded to return the main control switch to the on position.

18. The emergency shutdown system of claim 17, further comprising a vacuum gauge, and wherein the vacuum switch is adjustable for selecting precise levels of sensed vacuum at which to provide the electrical shut-off.

19. The emergency shutdown system of claim 18, further comprising a box with a lockable cover, and wherein the adjustable vacuum switch and the vacuum gauge are mounted in the box with the cover.

20. The emergency shutdown system of claim 17, further comprising a key-operated audible alarm overriding switch and a pump control box, wherein the start swith, on-off switch and vacuum bypass switch are combined in one four-position main control switch, and wherein the main control switch and the audible alarm overriding switch are mounted on the pump control box.

21. The emergency shutdown system of claim 20, wherein the pump switch is a pump relay, and wherein the pump relay is mounted in the pump control box under the cover.

22. The emergency shutdown system of claim 20, further comprising alarm terminals for external alarms, and wherein the alarms are external audible and visual alarms connected to the alarm terminals.

23. The emergency shutdown system of claim 17, further comprising a check valve connected between the influent side and the vacuum switch.

24. The emergency shutdown system of claim 23, further comprising a vacuum reset bleeder connected between the vacuum switch and the check valve.

25. The emergency shutdown system of claim 17, further comprising a timed auto start relay electrically connected to the main control switch for providing a timed start sequence for pump priming.

26. The emergency shutdown system of claim 25, wherein the timed auto start relay is adjustable and is electrically connected to the main control switch for energizing the auto start relay for bypassing the start switch when the water-circulating pump is operated with an automatic timer or in case of frequent power outages.

27. The emergency shutdown system of claim 17, further comprising an internal power supply connected to the power source and to the main control switch, to the pump switch and through the main control switch to the vacuum switch, and through the vacuum switch to the pump switch or to the alarms, for providing low voltage dc power to the system and for providing the electrical shut-off to the pump switch.

28. The emergency shutdown system of claim 27, wherein the power supply comprises a step-down transformer connected to the power source and a bridge rectifier connected to the step-down transformer and to the main control switch.

29. The emergency shut-down system of claim 28, wherein the pump switch is a pump relay, and further comprising a logic relay having a coil, normally-open contacts and normally-closed contacts, wherein the start switch is connected to the coil for energizing the coil and thereby closing the normally-open contacts for supplying power from the rectifier through the closed normally-open contacts to the pump relay, and wherein the vacuum switch is connected to the rectifier and to the coil for energizing the coil when the vacuum switch is in a low vacuum condition and thereby closing the normally-open contacts for supplying power to the pump relay while the coil is energized, and thereby allowing the normally-closed contacts to supply power to the alarms when the coil is deenergized.

30. The emergency shutdown of claim 17, further comprising and an audible alarm overriding switch connected to the audible alarm for preventing operation of the audible alarm.

31. The emergency shutdown system of claim 17, further comprising a vacuum line connected to and extending between the influent side and the vacuum switch.

32. An emergency shutdown system comprising an internal power supply for connecting to a power source, a pump relay for connecting to the power source and to a circulating pump in a pool or spa and a vacuum sensor for sensing low and high vacuum conditions on an influent side of the circulating pump, wherein the internal power supply further comprises a step-down transformer for connecting to the power source and a bridge rectifier connected to the step-down transformer for providing low-voltage dc power to the system, the system further comprising an on-off switch connected to the bridge rectifier, and a logic relay having a coil, and first and second normally-open contacts, a start switch connected to the rectifier and to the coil for temporarily energizing the coil and thereby closing the normally-open contacts for supplying power from the rectifier through the closed firtst normally-open contacts to the pump relay for energizing the pump relay and supplying power from the power source to the circulating pump, and wherein the vacuum sensor is connected to the rectifier and through the closed second normally-open contacts to the coil for energizing the coil when the vacuum sensor is in a low vacuum condition and thereby holding closed the first and second normally-open contacts for supplying power to the pump relay and supplying power to the coil while the coil is energized, and wherein the vacuum sensor upon sensing high vacuum condition opening and discontinuing power to the coil and allowing the normally-open contacts to open and discontinue power to the pump relay.

33. The emergency shutdown system of claim 32, wherein the logic relay further comprises a vacuuming bypass switch connected to the normally-closed contacts and to the pump relay for supplying power to the pump relay during vacuuming.

34. The emergency shutdown system of claim 33, further comprising alarms, including an audible alarm and a lighted alarm connected to the normally-closed contacts for supplying power to the alarms when the on-off switch is on and the normally-closed contacts are closed.

35. The emergency shutdown system of claim 34, further comprising an audible alarm overriding switch connected to the audible alarm for preventing operation of the audible alarm.

* * * * *